US005988369A

United States Patent [19]

Hsu

[11] Patent Number: 5,988,369

[45] Date of Patent: Nov. 23, 1999

[54] PEN-CASE DEVICE

[75] Inventor: Jeou-En Hsu, Hsin-Tien, Taiwan

[73] Assignee: CTS Computer Technology System Corp., Taipei, Taiwan

[21] Appl. No.: 09/315,352

[22] Filed: May 12, 1999

Related U.S. Application Data

[62] Division of application No. 08/965,413, Nov. 6, 1997.

[51] Int. Cl.[6] ..... A45C 11/34

[52] U.S. Cl. ..... 206/214; 206/215; 206/224; 211/69.1

[58] Field of Search ..... 206/214, 480, 206/477, 215, 224; 211/69.1, 60.1; 248/309.1

*Primary Examiner*—Paul T. Sewell
*Assistant Examiner*—Nhan T. Lam
*Attorney, Agent, or Firm*—Pro-Techtor International Services

[57] ABSTRACT

The present invention relates to an improvement pen-case device comprising a front clamp cover and a rear clamp cover, according to above architecture user not only could lay aside each kind of pens, but also lay up paper that could be more convenient to user for easy reading and operation. If add a magnet into present invention, it could absorb the scattered paper clip and pin; moreover, user also could put the clamp body at any absorbent place for flexible usage, meeting multi-purpose needs.

2 Claims, 4 Drawing Sheets

PEN-CASE DEVICE

This is divisional application of applicant's U.S. patent application Ser. No. 08/965,413, filed on Nov. 6, 1997.

BACKGROUND OF THE INVENTION

1. Field of the Invention

The present invention relates to an improvement pen-case architecture, thanks to this architecture allowing user not only could lay aside each kind of pens, but also lay up paper that could be more convenient to user for easy reading and operation; meantime, allowing user to absorb the scattered stationery like paper clip-pin etc.

2. Description of the Prior Art

Due to the limited office space today, the available personal space further hard to get, so what requirements to stationery is ingenious and practical besides with well-designed appearance. Unfortunately, available current stationery always have beautiful looking but not so practical, hard to use and feels pity to throw away them. Take the most frequently used stationery like pen as the example, two to three set at most been frequently used, but most of situations what we could see is a pen case located on the desktop, occupying the narrow desktop space, much inconvenient is hard to avoid. Another example, the typing operator normally need one or two piece of paper for reference, the best way for increasing efficiency is to use typing machine. But it further reduce the limited office space; more troublesome problem is user sometimes has no idea to put into storehouse or just lay aside over there after using. Such conditions often make the user feels inconvenient even uncomfortable.

SUMMARY OF THE INVENTION

It is therefore a primary objective of the present invention to provide an ingenious and practical pen-case device, allowing user as normal pen holder usage, and could erect the paper information during typing. Such mechanism just like put the paper into the central section between thumb, the first finger and the middle finger, forcing the paper in vertical situation; further fully utilize the office space to increase the operation efficiency in office. If add a magnet into present invention, it could absorb the scattered paper clip and pin; moreover, user also could put the clamp body at any absorbent place for flexible usage, meeting multi-purpose needs.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
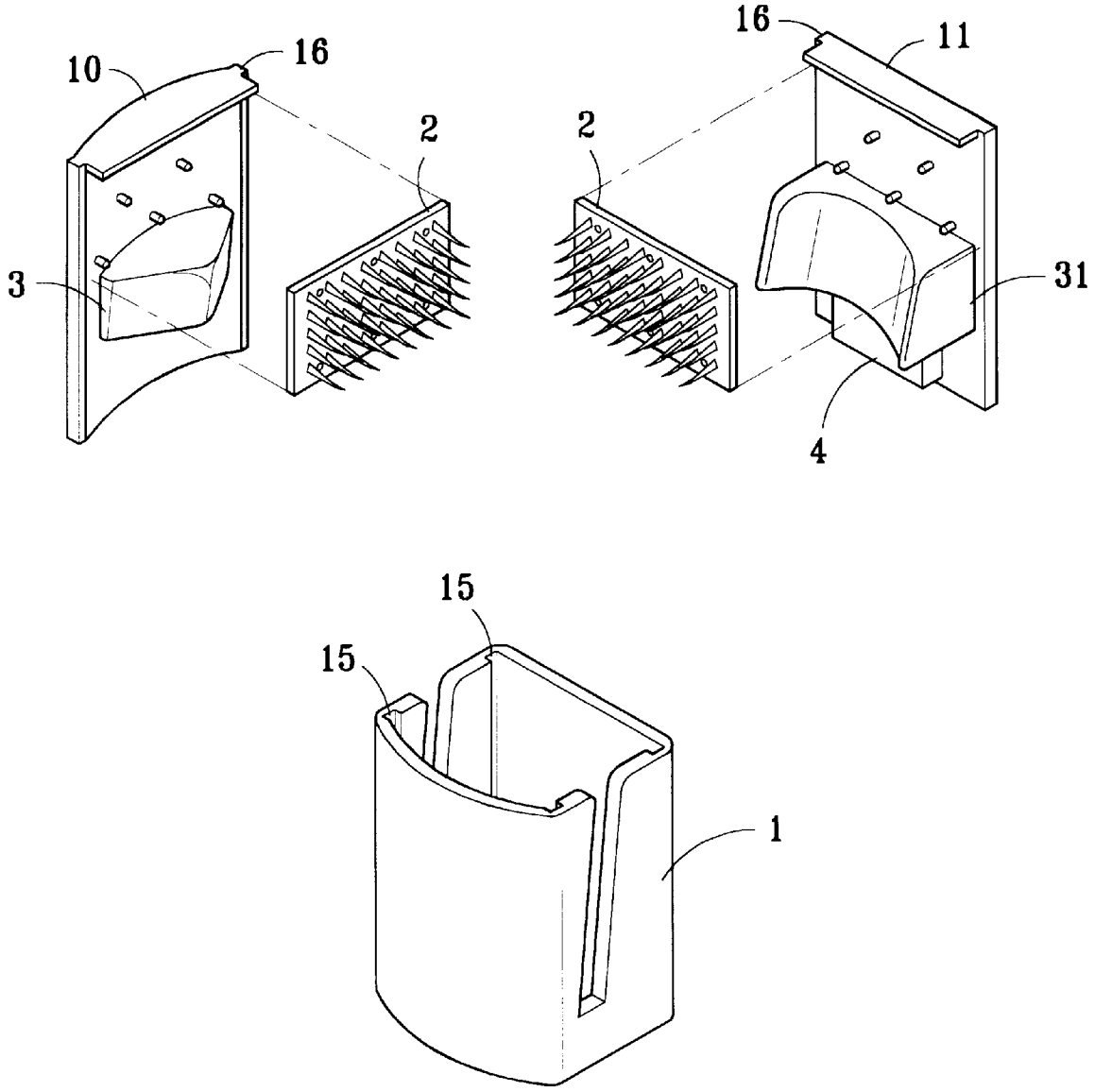
FIG. 1 is the exploded view of implement example according to the present invention.
Figure 2:
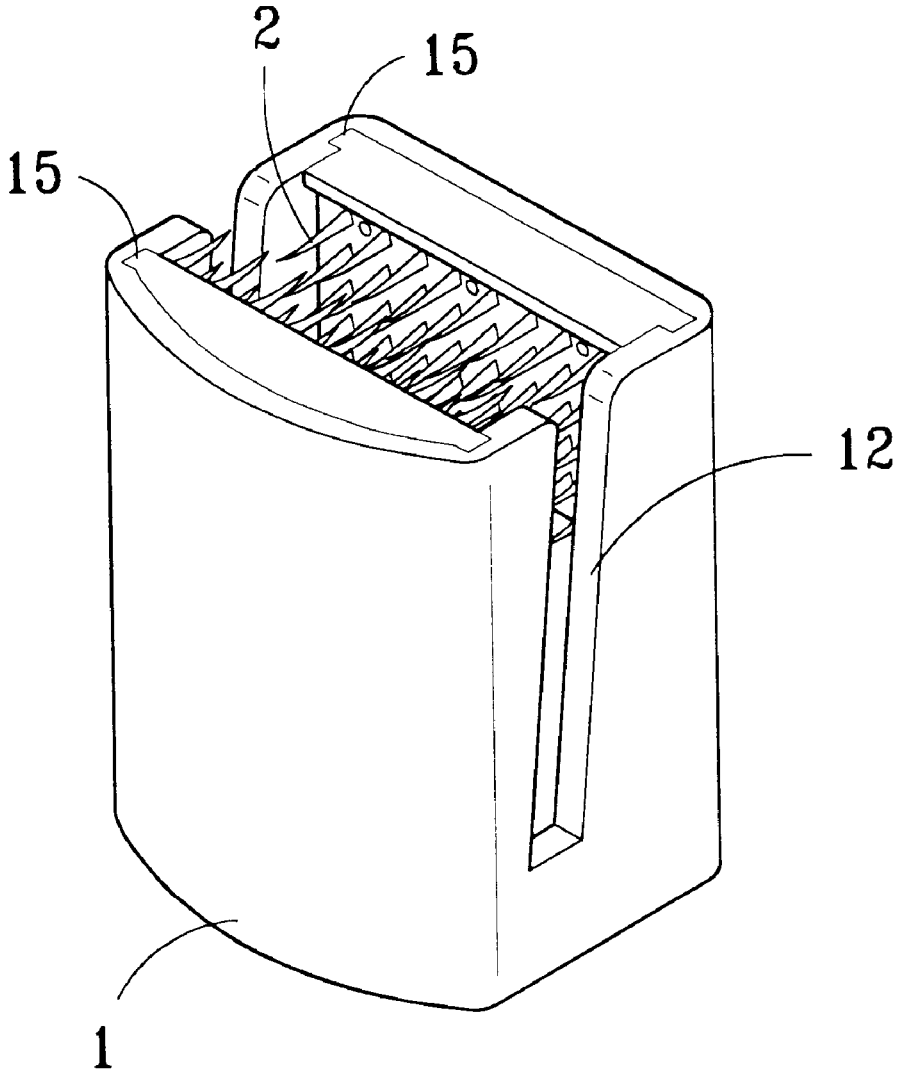
FIG. 2 is the general drawing of implement example according to the present invention.

Please refer to FIG. 1 and FIG. 2 that relates to the implement example according to the present invention comprising a tub-shape clamp body 1 in which set up an open groove 12 at both end from top to bottom been used to clamp the paper. Furthermore, the internal side of front and rear end installed with a guide slot 15. A front clamp cover 10 wherein installed internally with a convex splinter section 2 which downside has a convex body 3. And both end of front clamp cover 10 also setup a flange 16 from top to bottom been used to insert front clamp cover 10 into guide slot 15 of clamp body 1. Besides, a rear clamp cover 11 wherein installed internally with a convex splinter section 2 which downside has a concave body 31. And both end of rear clamp cover 11 also setup a flange 16 from top to bottom been used to insert rear clamp cover 11 into guide slot 15 of clamp body 1. The convex splinter section 2 pertains to front clamp cover 10 and rear clamp cover 11 described above is made of flexible materials.

Figure 3:
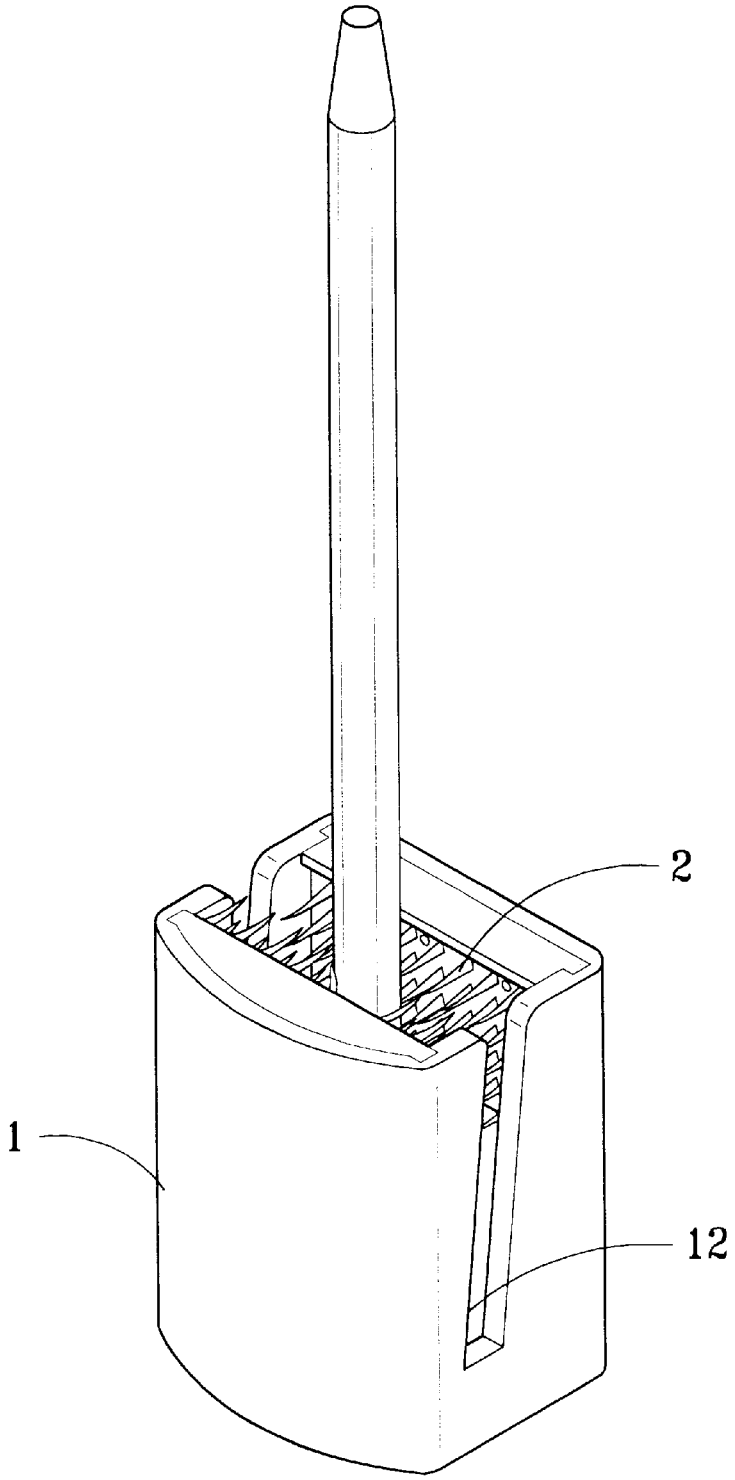
FIG. 3 is the application drawing according to the present invention.
Figure 4:
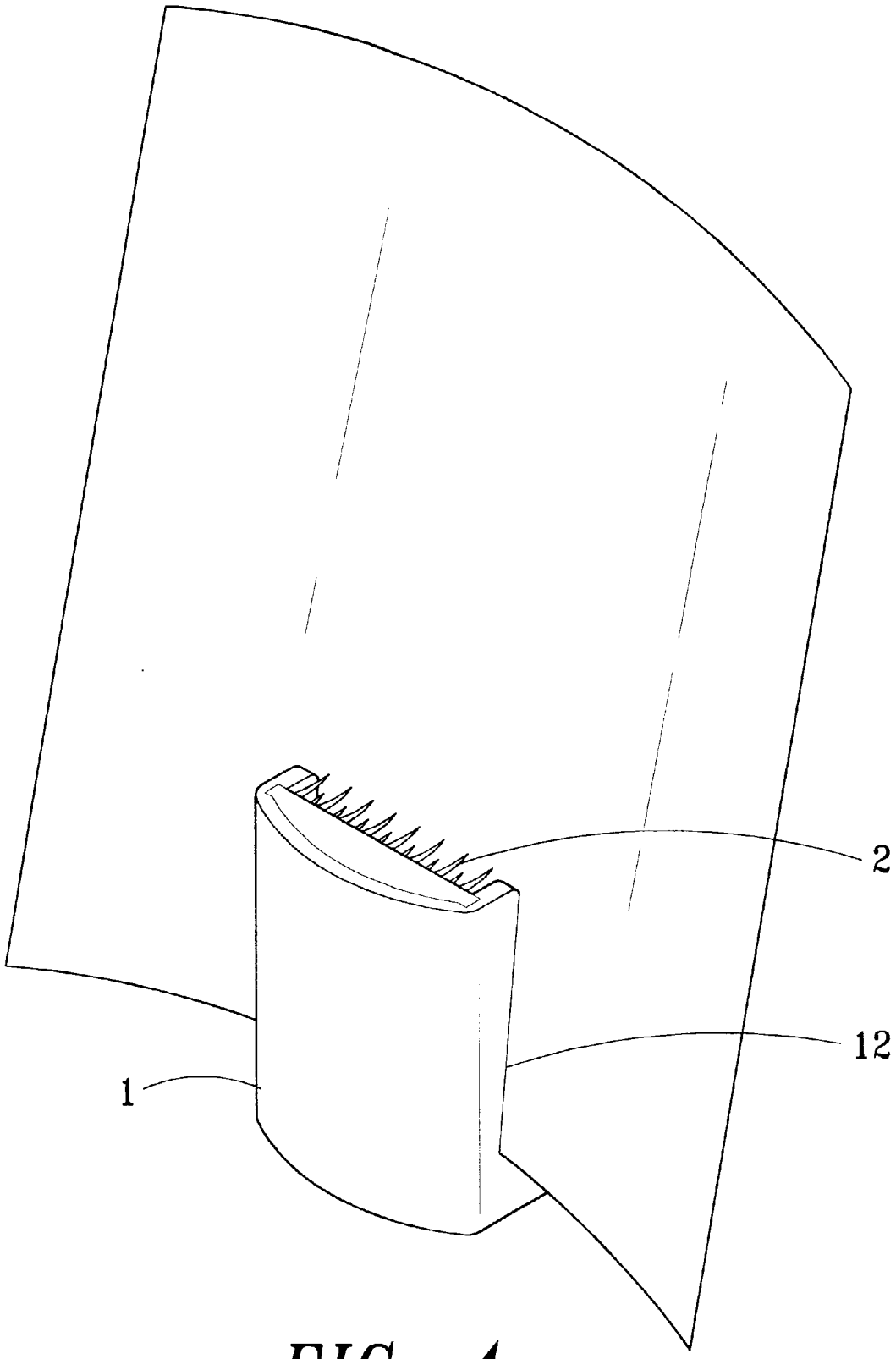
FIG. 4 is the application drawing according to the present invention.

According to the above architecture, user could put pen into the convex splinter section 2 vertically, and the pen will be not tilted due to the clamping action of flexible materials. (Please refer to FIG. 3) Moreover, the paper could pass through the slot between open groove 12 of clamp body 1 and paper clamping section from top to bottom, and be clamped in a stand-up way. (Please refer to FIG. 4) That means user could put paper pass through the arc-type slot formed by the convex body 3 of front clamp cover 10 and concave body 31 of rear clamp cover 11, the clamped paper will be forced into arc-shape and in a stand-up way.

For the real application, both the above two implement examples could set up a magnet 4 under the clamp body 1 to absorb the scattered stationery like paper clip, pin etc. (Please refer to FIG. 1) Moreover, user also could put the clamp body 1 at any absorbent place for flexible usage, or add the glue materials at the surface side of clamp body 1, user could attach at any convenient place like at personal computer side, it shows present invention could provide multiple and practical operation.

Many changes and modifications in the above described embodiment of the invention can, of course, be carried out without departing from the scope thereof Accordingly, to promote the progress in science and the useful arts, the invention is disclosed and is intended to be limited only by the scope of the appended claims.

What is claimed is:

1. A improvement pen-case device, comprising:

a tub-shape clamp body, wherein said clamp body set up an open groove from top to bottom at both ends been used to clamp the paper; and an internal side of front and rear end installed with a guide slot;

a front clamp cover, wherein said front clamp cover installed internally with a convex splinter section which downside has a convex body; and both ends of said front clamp cover also setup a flange from top to bottom used to insert said front clamp cover into front-end guide slot of clamp body;

a rear clamp cover, wherein said rear clamp cover installed internally with a convex splinter section which downside has a concave body; and both end of said rear clamp cover also setup a flange from top to bottom used to insert said rear clamp cover into rear-end guide slot of clamp body;

wherein, the convex splinter section pertains to said front clamp cover and rear clamp cover is made of flexible materials; A user can insert a pen into said convex splinter sections vertically and said pen will not be tilted; or a user can pass a piece of paper through said open groove of said clamp body, and arc-shaped slot formed by said convex body of said front clamp cover and said concave body of said rear clamp cover, the paper will be clamped and forced into an arc-shaped and in a stand-up position.

2. A pen-case device as claimed in claim 5, wherein said clamp body could embed a magnet.

* * * * *